US009360250B2

(12) United States Patent
Ha et al.

(10) Patent No.: US 9,360,250 B2
(45) Date of Patent: Jun. 7, 2016

(54) PROCESS AND APPARATUS FOR THE SEPARATION OF AIR BY CRYOGENIC DISTILLATION

(71) Applicant: L'Air Liquide Societe Anonyme pour l'Etude et l'Exploitation des Procedes Georges Claude, Paris (FR)

(72) Inventors: Bao Ha, San Ramon, CA (US); Jean-Renaud Brugerolle, Houston, TX (US)

(73) Assignee: L'Air Liquide Société Anonyme Pour L'Étude Et L'Exploitation Des Procedes Georges Claude, Paris (FR)

( * ) Notice: Subject to any disclaimer, the term of this patent is extended or adjusted under 35 U.S.C. 154(b) by 683 days.

(21) Appl. No.: 13/778,700

(22) Filed: Feb. 27, 2013

(65) Prior Publication Data

US 2013/0219959 A1 Aug. 29, 2013

(30) Foreign Application Priority Data

Feb. 29, 2012 (EP) ..... 12305244

(51) Int. Cl.
*F25J 3/00* (2006.01)
*F25J 3/04* (2006.01)

(52) U.S. Cl.
CPC ..... *F25J 3/04448* (2013.01); *F25J 3/04* (2013.01); *F25J 3/042* (2013.01); *F25J 3/0409* (2013.01); *F25J 3/0429* (2013.01); (Continued)

(58) Field of Classification Search
CPC . F25J 3/04448; F25J 3/04454; F25J 2200/08; F25J 2200/10; F25J 2200/32; F25J 3/0409; F25J 2200/78; F25J 2250/52; F25J 2230/08; F25J 2230/30; F25J 2230/40; F25J 3/04054; F25J 3/0429; F25J 3/042; F25J 3/04175; F25J 3/04393; F25J 3/04296; F25J 3/04303; F25J 3/04381
See application file for complete search history.

(56) References Cited

U.S. PATENT DOCUMENTS 5,682,764 A * 11/1997 Agrawal ..... F25J 3/0409 62/646
2001/0052243 A1* 12/2001 Davidian ..... F25J 3/04018 62/643
2011/0146343 A1 6/2011 Ha et al.

FOREIGN PATENT DOCUMENTS

EP 1055891 A1 11/2000
EP 1189003 A1 3/2002
(Continued)

OTHER PUBLICATIONS

EP 12305244.1, EP Search Report, Aug. 7, 2012.

*Primary Examiner* — Frantz Jules
*Assistant Examiner* — Keith Raymond
(74) *Attorney, Agent, or Firm* — Justin K. Murray

(57) ABSTRACT

The present invention relates to a process and apparatus for the separation of air by cryogenic distillation. In particular, it relates to a process for separation of air using three cryogenic distillation columns for the production of gaseous oxygen. Certain embodiments of the invention are particularly efficient for the production of gaseous oxygen at pressures between 30 and 45 bars abs, in which the oxygen is produced by removing liquid oxygen from a distillation column, pressurizing the oxygen and vaporizing the pressurized liquid by heat exchange with air.

17 Claims, 6 Drawing Sheets

(52) U.S. Cl.
CPC ..... *F25J 3/04054* (2013.01); *F25J 3/04175* (2013.01); *F25J 3/04296* (2013.01); *F25J 3/04303* (2013.01); *F25J 3/04381* (2013.01); *F25J 3/04393* (2013.01); *F25J 3/04454* (2013.01); *F25J 2200/08* (2013.01); *F25J 2200/10* (2013.01); *F25J 2200/32* (2013.01); *F25J 2200/50* (2013.01); *F25J 2200/78* (2013.01); *F25J 2205/30* (2013.01); *F25J 2230/30* (2013.01); *F25J 2230/40* (2013.01); *F25J 2235/52* (2013.01); *F25J 2245/02* (2013.01); *F25J 2250/04* (2013.01); *F25J 2250/52* (2013.01); *F25J 2290/12* (2013.01)

(56) References Cited

FOREIGN PATENT DOCUMENTS

| | | | |
|---|---|---|---|
| EP | 1199532 | A1 | 4/2002 |
| JP | 11132652 | A | 5/1999 |

* cited by examiner

PROCESS AND APPARATUS FOR THE SEPARATION OF AIR BY CRYOGENIC DISTILLATION

CROSS REFERENCE TO RELATED APPLICATIONS

This application claims the benefit under 35 U.S.C. §119 (e) to European application No. 12305244.1, filed Feb. 29, 2012, the entire contents of which are incorporated herein by reference.

TECHNICAL FIELD OF THE INVENTION

The present invention relates to a process and apparatus for the separation of air by cryogenic distillation. In particular, it relates to a process for separation of air using three cryogenic distillation columns for the production of gaseous oxygen.

The process is particularly efficient for the production of gaseous oxygen at pressures between 30 and 45 bars abs, in which the oxygen is produced by removing liquid oxygen from a distillation column, pressurizing the oxygen and vaporizing the pressurized liquid by heat exchange with air.

SUMMARY OF THE INVENTION

According to an object of the invention, there is provided a process for the separation of air by cryogenic distillation in which air is purified, cooled and sent to a first distillation column of a column system wherein it is separated into an oxygen enriched liquid and a nitrogen enriched gas, oxygen enriched liquid or a liquid derived therefrom is sent from the first column to a top condenser of a second column operating at a lower pressure than the first column and is partially vaporized therein, the bottom of the second column is warmed via a bottom reboiler, liquid from the bottom of the second column is sent to an intermediate point of a third column operating at a lower pressure than the second column, nitrogen enriched liquid from the top of the second column is sent to the top of the third column, oxygen rich liquid is removed from the bottom of the third column, pressurized and vaporized by heat exchange with air, characterized in that oxygen enriched liquid from the top condenser of the second column is sent to an intermediate point of the second column to be separated therein.

According to other optional features:

- all the fluid sent to be separated in the second column comes from the top condenser or from the top condenser and the third column.
- all the oxygen enriched fluid removed from the bottom of the first column is sent to the top condenser.
- the oxygen enriched liquid or the liquid derived therefrom is pressurized after being removed from the top condenser and before being sent to the second column.
- the liquid is pressurized by a pump and/or by hydrostatic pressure.
- the liquid sent to be separated is derived from the oxygen enriched liquid by cryogenic separation in a fourth column operating at a pressure lower than the pressure of the second column to enrich the oxygen rich liquid still further in oxygen.
- the fourth column is fed at the top by nitrogen enriched liquid from the first column.
- the fourth column is fed at the bottom by feed air.
- the process comprises expanding purified and cooled air and sending it to the fourth column.

- the oxygen rich liquid is pressurized to a pressure between 30 and 45 bars abs.
- no gaseous nitrogen stream is removed as a gaseous product from the first column.
- the air is cooled in a heat exchanger from a temperature above 0° C. to a temperature below −150° C., at least part of the air being removed from an intermediate point of the heat exchanger, compressed in a cold compressor, sent back to the heat exchanger and separated in the column system.
- at least 35%, preferably at least 40%, or even at least 50% of the air sent to the column system is expanded in a first turbine to the pressure of the third or a fourth column.
- the inlet temperature of the first turbine is lower than the inlet temperature of the cold compressor.

According to another object of the invention, there is provided an apparatus for the separation of air by cryogenic distillation comprising a column system having a first column, a second column and a third column, a heat exchanger, means for sending purified, cooled air from the heat exchanger to the first distillation column wherein it is separated into an oxygen enriched liquid and a nitrogen enriched gas, a conduit for sending oxygen enriched liquid or a liquid derived therefrom from the first column to a top condenser of the second column operating at a lower pressure than the first column, the second column having a bottom reboiler, a conduit for sending liquid from the bottom of the second column to an intermediate point of a third column operating at a lower pressure than the second column, a conduit for sending nitrogen enriched liquid from the top of the second column to the top of the third column, a conduit for removing oxygen rich liquid from the bottom of the third column, a pump for pressurizing the oxygen rich liquid, a conduit for sending pressurized oxygen rich liquid to the heat exchanger to be vaporized by heat exchange with air, characterized in that it comprises a conduit for sending oxygen enriched liquid from the top condenser of the second column to an intermediate point of the second column to be separated therein.

The apparatus may also comprise

- pressurization means, which may be a pump and/or hydrostatic pressure, to pressurize the liquid from the top condenser upstream of the intermediate point of the second column.
- a turbine and a conduit for sending air from the heat exchanger to the turbine and a conduit for sending expanded air from the turbine to the third column and/or a fourth column.
- a fourth column adapted to send oxygen enriched liquid from the fourth column to the top condenser.
- the fourth column is positioned above the third column or above the second column.

One advantage of the present invention is that by sending a large amount of expanded air to the second or (where present) fourth column, the amount of liquid reflux sent to the second column is reduced. Thus, since the amount of gaseous nitrogen produced is constant, it will be understood that the feed and reflux streams to the low pressure column will be subcooled to a greater degree than is usually the case, so that there is less flash.

Another advantage linked to the high turbine flow of air sent to the second or (where present) fourth column is that the turbine temperature can be cooler and consequently liquid may formed at the turbine outlet. Approximately 4.5% of the expanded air is liquefied in the turbine, in this case. This means that more of the feed air can be sent to the distillation in gaseous form.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

DETAILED DESCRIPTION

The invention will be described in greater detail with respect to the figures.

Figure 1:
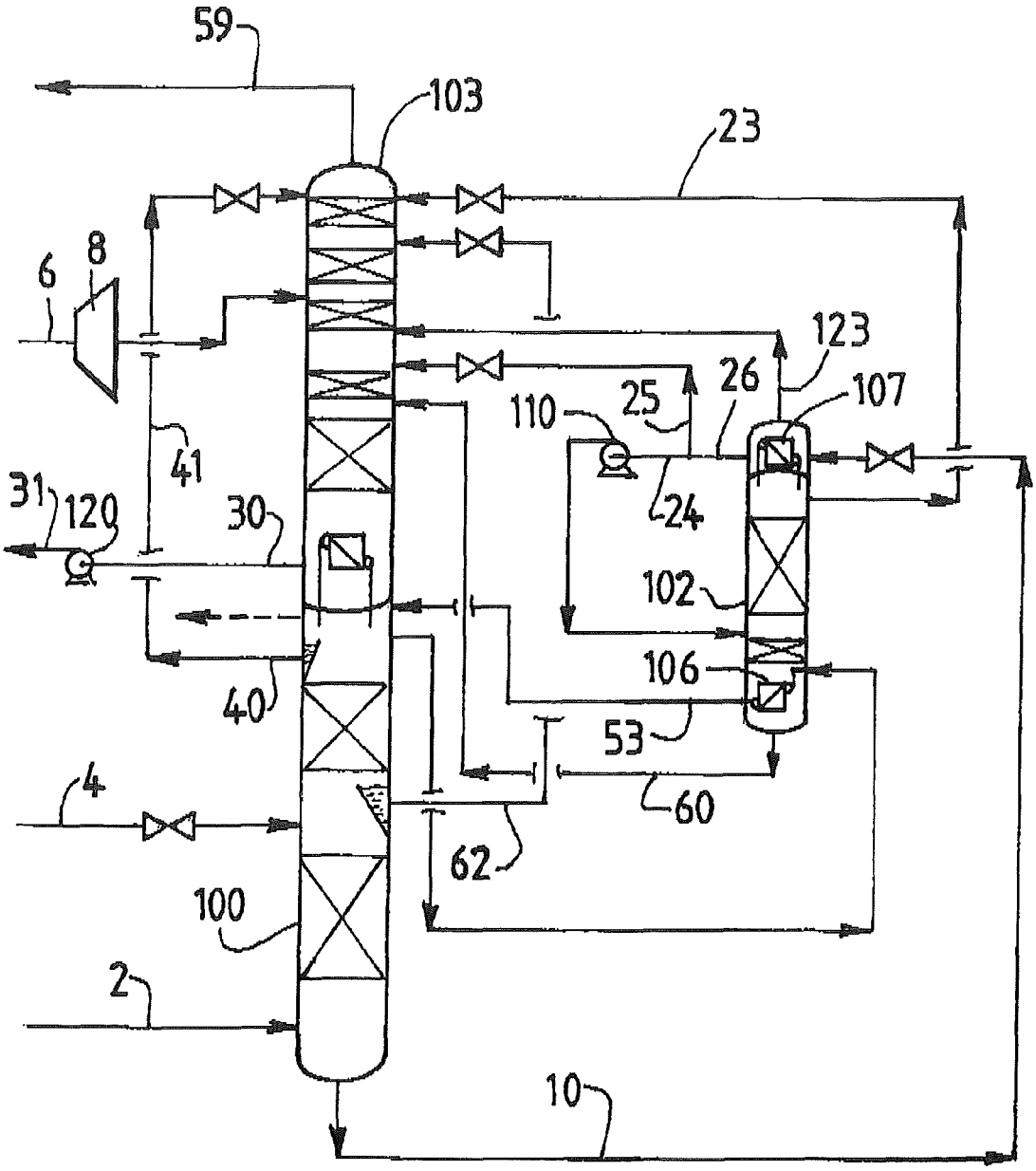
FIG. 1 represents a column system to be used in accordance with an embodiment of the invention.

In the process of FIG. 1, a column system is used including a first column 100 operating at a high pressure, a second column 102 operating at an intermediate pressure, lower than the high pressure and a third column, thermally integrated with the first column via a bottom reboiler, operating at a low pressure, lower than the intermediate pressure.

Gaseous air 2 is the principal feed to first column 100 which is also fed by a stream of liquid air 4 at a higher introduction point than that of stream 2. Liquid air stream 4 is shown as a single stream but can be composed of multiple liquid air streams (not shown) resulting from the thermal optimization of the main heat exchanger. A stream of air 6 is expanded in a turbine 8 and sent to an intermediate point of third column 103. No air is sent directly to second column 102, though this could be envisaged. Oxygen enriched liquid 10 is removed from the bottom of column 100, expanded in a valve and sent to the top condenser 107 of the second column 102. In the top condenser, the oxygen enriched liquid is partially vaporized by heat exchanger with the top gas of the second column 102, thereby condensing the top gas which returns to the second column 102 as reflux. This option gives the optimal temperature for the top condenser; however it is also possible to send only a part of the oxygen enriched liquid 10 to the top condenser and to send the rest to the third column 103, for example.

The non-vaporized liquid 26 from the condenser is divided in two. One part 25 is sent to the third column 103 and the rest 24 is pressurized in a pump 110 and sent to a lower region of the second column 102 as feed. The reboil of the second column 102 is ensured by a stream of gaseous nitrogen enriched fluid from the top of the first column. The fluid is liquefied in bottom reboiler 106 of the second column 102 and sent back to the top of the first column as stream 53. A stream of the same gas is also condensed in the bottom reboiler of the third column. Gaseous nitrogen may be removed at the top of the first column as a product stream.

Liquid 60 containing between 65 and 75% mol. oxygen is removed from the bottom of the second column, expanded and sent to the third column 103. Vaporized oxygen enriched liquid 123 from the top condenser is also fed to column 103. Nitrogen enriched liquid from the top of the second column 102 is expanded and sent to the top of the third column 103 as stream 23.

A liquid stream 62 having a composition similar to air is removed from the first column, expanded and sent to the third column. A liquid nitrogen stream from the top of the first column is sent to the top of the third column as stream 41.

Nitrogen enriched gas 59 is removed from the top of the third column 103. Oxygen enriched liquid 30 is removed from the bottom of the third column 103, and pressurized in pump 120 to between 30 and 45 bars to form high pressure stream 31.

Figure 2:
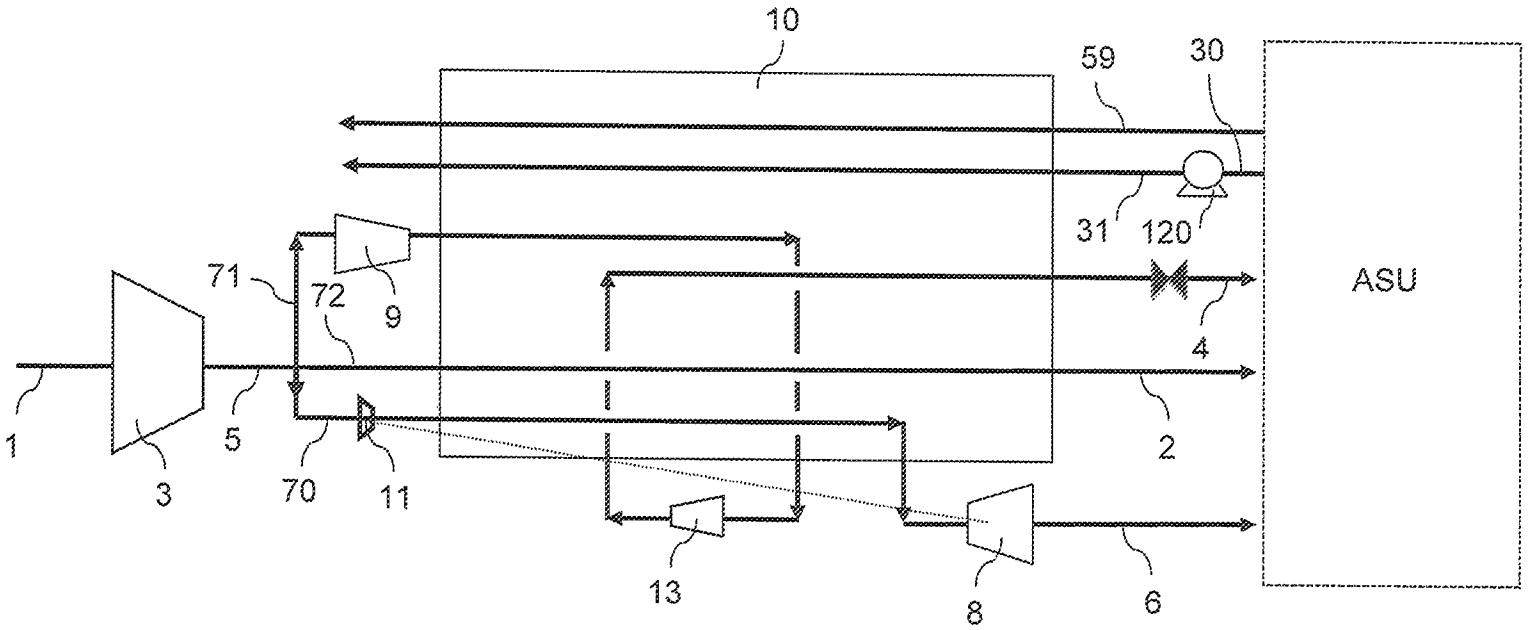
FIG. 2 represents a heat exchange system to be used in accordance with an embodiment of the invention.

FIG. 2 shows a heat exchange system to be used to cool the feed streams and warm the product streams of FIG. 1. Thus the air 1 is compressed in compressor 3 to form compressed stream 3. After cooling and purification for moisture and carbon dioxide removal (not shown), the compressed air is divided into three portions. One portion 72 is cooled completely in heat exchanger 10 and sent to the bottom of the first column as stream 2, the column system being designated as ASU. Another portion 70 is boosted in a warm booster compressor 11, partially cooled in heat exchanger 10 and expanded in a turbine 8 to form stream 6 to be sent to the third column 103.

A final portion 71 is compressed in a further warm booster 9, cooled partially in heat exchanger 10, further compressed in cold booster 13, cooled in the heat exchanger 10, liquefied and sent to the column system as liquid stream 4.

The high pressure liquid oxygen 31 at between 30 and 45 bars is vaporized in the heat exchanger 10 to form gaseous pressurized oxygen. The nitrogen enriched gas 59 is also warmed in the heat exchanger 10. Boosters 9 and 13 can be driven by electric motor(s).

Figure 3:
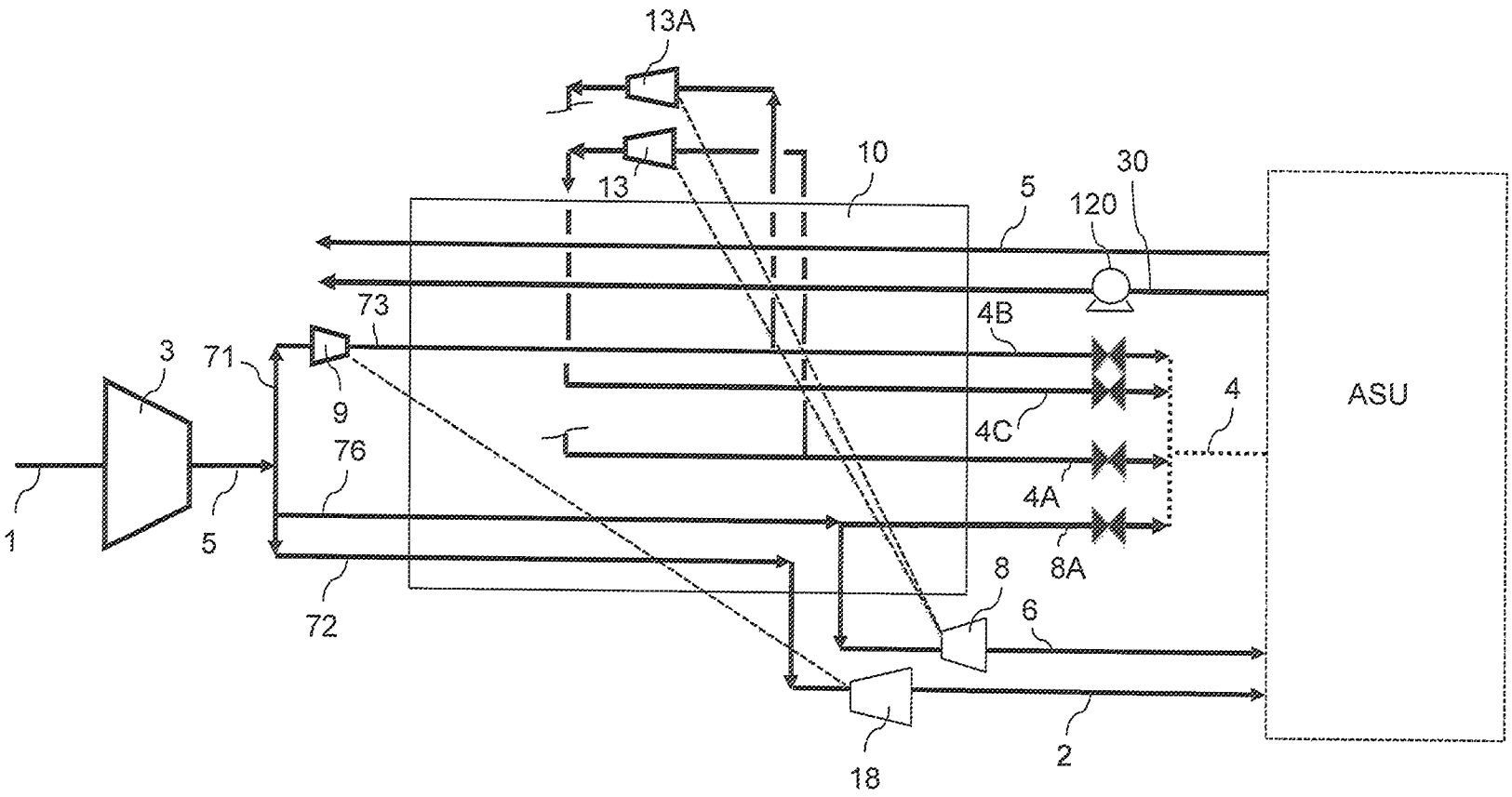
FIG. 3 represents a heat exchange system to be used in accordance with an embodiment of the invention.

FIG. 3 shows that it is also possible to modify FIG. 2 to avoid using the booster 11. Two streams 70, 72 enter the heat exchanger at the outlet pressure of compressor 1. In this case, it is possible to send stream 72 to another turbine 18 after partial cooling in the heat exchanger. In this case, part of stream 70 as part of the air 8A is fully cooled in the heat exchanger 10, liquefied and sent to the column system ASU. The rest of stream 70 is partially cooled in exchanger 10, expanded in turbine 8 and sent to the column system ASU as stream 8.

In this case, two cold boosters 13,13A are arranged in series to compress air 4C to be liquefied. The efficiency can be improved by cooling and liquefying a fraction of stream 73 to form liquid stream 4B. Similarly, liquid stream 4A can be extracted after compression of booster 13A. All liquid air streams 4A, 4B, 4C and 8A are sent as feeds to the column 100. For illustration purposes, these streams can be combined and shown as a single stream 4.

The high pressure liquid oxygen 31 at between 30 and 45 bars is vaporized in the heat exchanger 10 to form gaseous pressurized oxygen. The nitrogen enriched gas 59 is also warmed in the heat exchanger 10. Booster 9 can be driven by electric motor(s). Stream 71 is compressed in warm booster 9 to form stream 73. Part of stream 73 is completely cooled in the heat exchanger to form stream 4B. The rest is partially cooled, compressed in cold booster 13A, warmed in exchanger from one intermediate temperature to another and divided in two. One part 41 is cooled to the cold end of the exchanger and expanded as stream 4A.

The rest 4C is compressed in cold compressor 13, having an inlet temperature colder than that compressor 13A, sent back to the exchanger at an intermediate temperature and cooled to the cold end of the exchanger before being expanded into the column system.

Both of the cold boosters 13 and 13A are driven by turbine 8.

Figure 4:
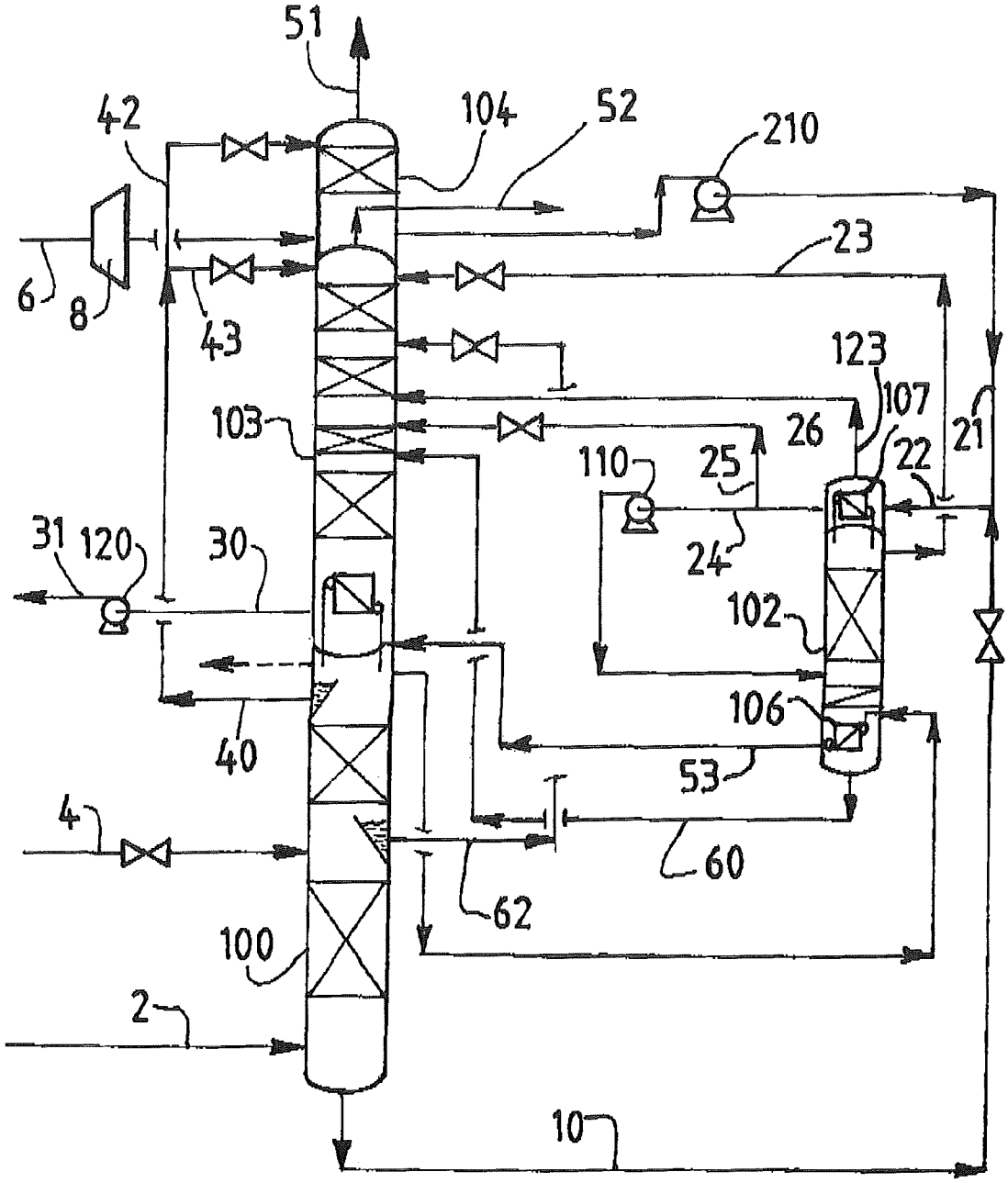
FIG. 4 represents a column system to be used in accordance with an embodiment of the invention.

In FIG. 4, a fourth column 104 is placed above the top of the third column 103 and operates at a pressure just slightly below that of the third column This column 104 is fed at the top by part 42 of the nitrogen enriched liquid 40, the rest 43 being sent as before to the top of the third column 103. A gas 52 and a gas 51 are removed from the tops of the third and fourth columns respectively, both being nitrogen enriched. The liquid 21 from the bottom of the fourth column is sent via a pump 210, or by hydrostatic head if the layout permits, to the top condenser 107 to be vaporized therein, to ensure that there is sufficient cooling for the top condenser.

The fourth column is also fed at the bottom by the air stream 6, no longer sent to the column 103, via turbine 8.

In other respects, the column system is as in FIG. 1.

Figure 5:
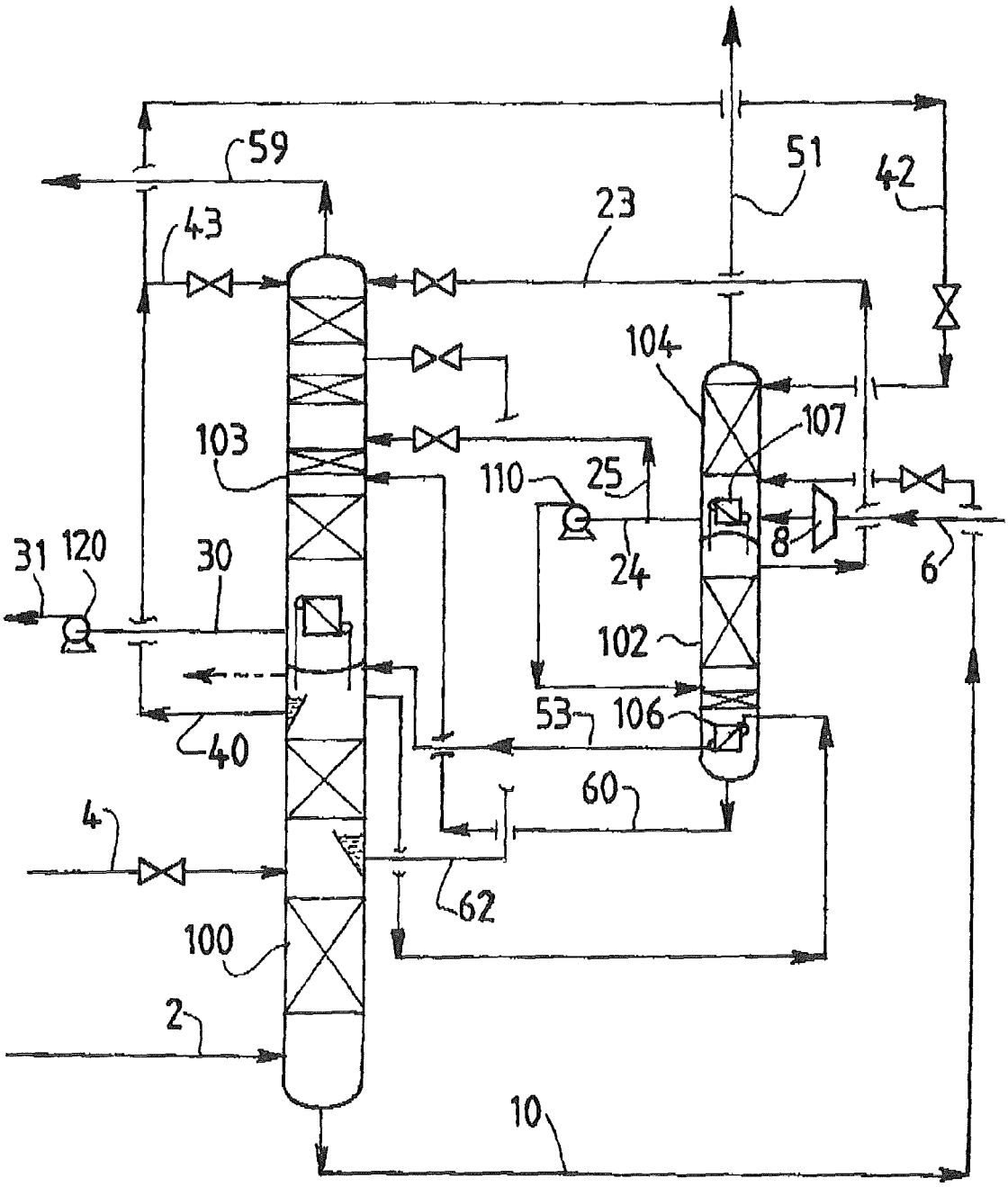
FIG. 5 represents a column system to be used in accordance with an embodiment of the invention.

In FIG. 5, the fourth column 104 is placed above the second column, such that the top condenser 107 becomes the bottom reboiler of the fourth column. The fourth column can operate at a pressure slightly lower than that of the third column. The second column operates at 2.3 bars. The oxygen enriched liquid 10 is expanded and fed to the bottom of the fourth column 104 and is separated in the column. Air from the turbine 8 is also sent to the bottom of the fourth column 104 via stream 6. A nitrogen enriched gaseous stream 51 is removed from the top of the fourth column. The liquid stream 26 leaving the top condenser 107 is divided in two and the liquid 24 is as before used to feed the second column 102.

Figure 6:
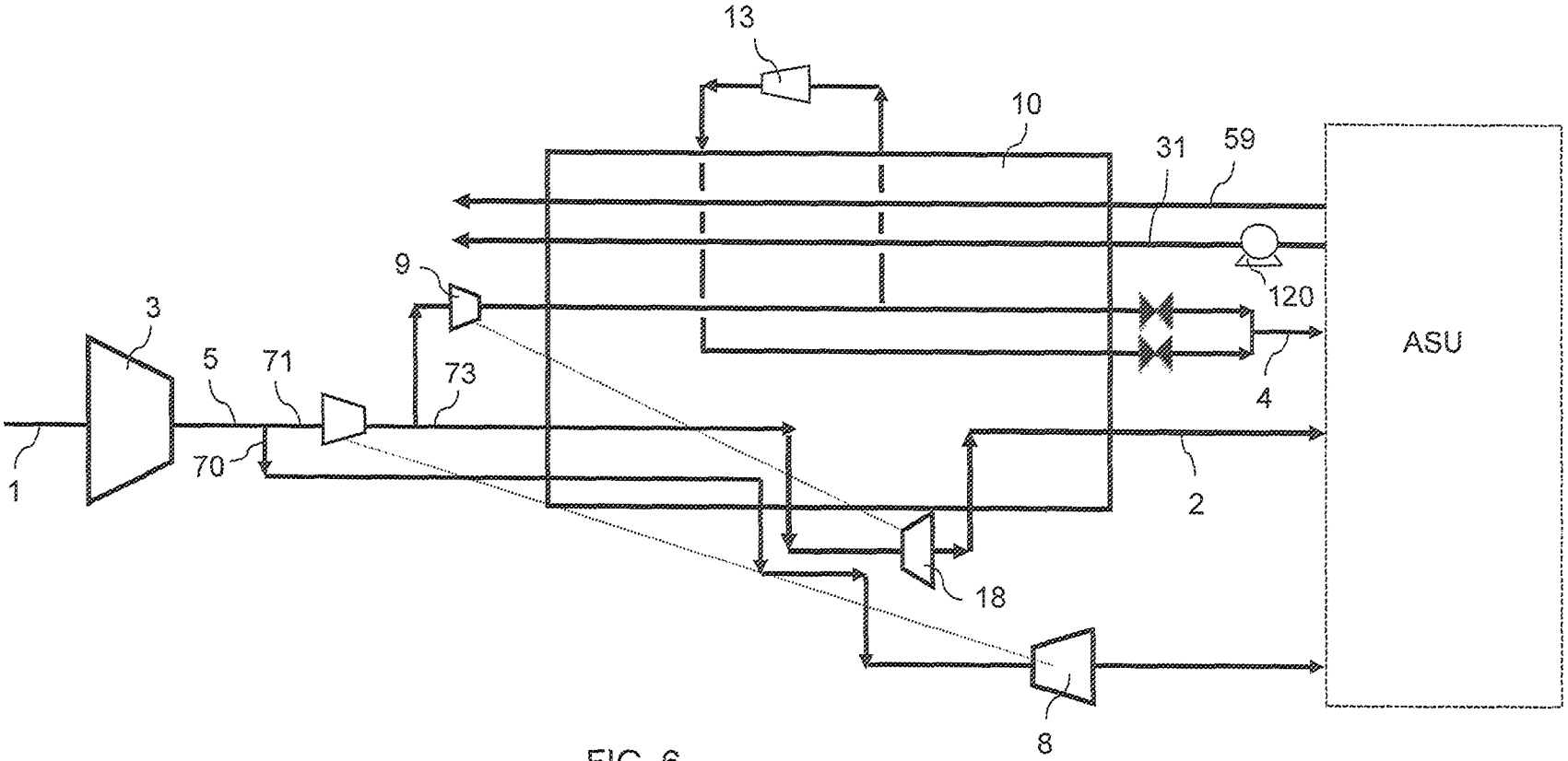
FIG. 6 represents a heat exchange system to be used in accordance with an embodiment of the invention.

FIG. 6 shows the heat exchanger system wherein the air compressed in compressor 3 to 7.7 bars is divided in two. One part 71 is boosted to 9.6 bars and divided to form stream 73, 74. The stream 73 is cooled partially in heat exchanger 10 and expanded in turbine 18, before being again cooled in the heat exchanger to the cold end and sent to the column system as stream 2. Stream 70 at the outlet pressure of compressor 3 is cooled to an intermediate point in the heat exchanger 10, expanded in turbine 8 and sent to the column system to the third column 103 or the fourth column 104 of FIG. 3 or 4 as stream 6. The remainder 74 is boosted in booster 9 to 12 bars, partially cooled in the heat exchanger and divided in two. One part is compressed in cold compressor 13 to 53 bars, thus having a compression ratio of 4.5, further cooled in exchanger 10 and then expanded into the column system. The rest of the air boosted in booster 9 is cooled to the cold end, expanded and sent to the column system.

The oxygen stream 30 at 95% mol oxygen is pressurized and vaporized at 40 bars a.

The advantage of this particular set-up is that since the second column 102 is at a lower pressure of 2.3 bars, as opposed to 2.5 bars for FIG. 3, the oxygen content in the bottom of the second column can be increased.

In all of the figures, the stream 6 expanded in turbine 8 can be partially liquefied. Preferably between 2 and 5% of the expanded air is liquefied.

In all of the figures, the air stream 70 represents at least 35%, preferably at least 40% or even at least 50% of the total feed air to be separated. Because of the large amount of air sent directly to the second or fourth column, the first column can have a much smaller diameter than usual, for example twice as small as usual. In the case where the turbine expanded air is sent to the fourth column 104, the third column can also have a much reduced diameter.

Another advantage of the process is that the majority of the waste gas 59 is not sent to the regeneration of the adsorption system for purifying the air. It is this feature which allows the fourth column or minaret to operate at a lower pressure than the third column.

The turbine expansion of a large quantity of air down to a particularly low temperature produces a great deal of refrigeration and the use of the cold booster can dissipate efficiently this refrigeration such that the energy consumption can be reduced considerably.

Preferably for all the figures, reboiler 106 is a falling film vaporizer. The minimum temperature difference is 0.5° C. and the average temperature difference is between 0.9 and 1.1° C. The expected vaporization rate is less than 33%. Preferably for all the figures, condenser 107 is a falling film vaporizer. The minimum temperature difference is 0.5° C. and the average temperature difference is between 0.9 and 1.1° C. Again, the expected vaporization rate is less than 33%.

Although not shown in the figures, it is possible to send feed air to the second column in gaseous or liquid form. In all of the figures, the process produces no or a small amount of liquid product (about 3% of oxygen product) as a final product.

In all of the figures, pump 110 may be replaced or supplemented by hydrostatic pressure.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a non-exclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary a range is expressed, it is to be understood that another embodiment is from the one.

Optional or optionally means that the subsequently described event or circumstances may or may not occur. The description includes instances where the event or circumstance occurs and instances where it does not occur.

Ranges may be expressed herein as from about one particular value, and/or to about another particular value. When such particular value and/or to the other particular value, along with all combinations within said range.

All references identified herein are each hereby incorporated by reference into this application in their entireties, as well as for the specific information for which each is cited.

The invention claimed is:

1. A process for the separation of air by cryogenic distillation in which air is purified, cooled and sent to a first distillation column of a column system, wherein the air is separated into an oxygen enriched liquid and a nitrogen enriched gas, the process comprising the steps of:

introducing the oxygen enriched liquid or a liquid derived from the oxygen enriched liquid from the first column to a top condenser of a second column operating at a lower pressure than the first column, wherein the oxygen enriched liquid or a liquid derived from the oxygen enriched liquid is partially vaporized;

warming the bottom of the second column via a bottom reboiler;

introducing liquid from the bottom of the second column to an intermediate point of a third column operating at a lower pressure than the second column;

introducing nitrogen enriched liquid from the top of the second column to the top of the third column; and removing oxygen rich liquid from the bottom of the third column, such that the oxygen rich liquid is pressurized and vaporized by heat exchange with air, wherein the oxygen enriched liquid from the top condenser of the second column is sent to an intermediate point of the second column to be separated within the second column.

2. The process as claimed in claim 1, wherein all the fluid sent to be separated in the second column comes from the top condenser or from the top condenser and the third column.

3. Process as claimed in claim 1, wherein the oxygen enriched liquid or the liquid derived from the oxygen enriched liquid is pressurized after being removed from the top condenser and before being sent to the second column.

4. The process as claimed in claim 3, wherein the oxygen enriched liquid or the liquid derived from the oxygen enriched liquid pressurized by a pump and/or by hydrostatic pressure.

5. The process as claimed in claim 1, wherein the oxygen enriched liquid introduced into the top condenser of the second column is further derived from another oxygen enriched liquid stream by cryogenic separation in a fourth column operating at a pressure lower than the pressure of the second column to enrich the oxygen rich liquid introduced into the top condenser still further in oxygen.

6. The process as claimed in claim 5, comprising expanding purified and cooled air and sending the expanded purified and cooled air to the fourth column.

7. The process as claimed in claim 1, wherein the oxygen rich liquid is pressurized to a pressure between 30 and 45 bars abs.

8. The process as claimed in claim 1, wherein no gaseous nitrogen stream is removed as a gaseous product from the first column.

9. The process as claimed in claim 1, wherein the air is cooled in a heat exchanger from a temperature above 0° C. to a temperature below −150° C., at least part of the air being removed from an intermediate point of the heat exchanger, compressed in a cold compressor, sent back to the heat exchanger and separated in the column system.

10. The process as claimed in claim 1, wherein at least 35% of the air sent to the column system is expanded in a first turbine to the pressure of the third or a fourth column.

11. The process as claimed in claim 10, wherein the inlet temperature of the first turbine is lower than the inlet temperature of the cold compressor.

12. An apparatus for the separation of air by cryogenic distillation, the apparatus comprising:

a column system having a first column, a second column and a third column;

a heat exchanger, means configured to send purified, cooled air from the heat exchanger to the first column wherein the purified, cooled air is separated into an oxygen enriched liquid and a nitrogen enriched gas;

a conduit configured to send the oxygen enriched liquid or a liquid derived from the oxygen enriched liquid from the first column to a top condenser of the second column operating at a lower pressure than the first column, the second column having a bottom reboiler, a conduit configured to send liquid from the bottom of the second column to an intermediate point of the third column operating at a lower pressure than the second column;

a conduit configured to send nitrogen enriched liquid from the top of the second column to the top of the third column;

a conduit configured to remove oxygen rich liquid from the bottom of the third column;

a pump configured to pressurize the oxygen rich liquid;

a conduit configured to send the pressurized oxygen rich liquid to the heat exchanger to be vaporized by heat exchange with air, a conduit configured to send the oxygen enriched liquid from the top condenser of the second column to an intermediate point of the second column to be separated within the second column.

13. The apparatus according to claim 12, further comprising pressurization means configured to pressurize the liquid from the top condenser upstream of the intermediate point of the second column wherein the pressurization means is selected from the group consisting of a pump, hydrostatic pressure, and combinations thereof.

14. The apparatus according to claim 12, further comprising:

a turbine;

a conduit configured to send air from the heat exchanger to the turbine; and a conduit configured to send expanded air from the turbine to the third column and/or a fourth column.

15. The apparatus according to claim 14, further comprising a fourth column adapted to send a second oxygen enriched liquid from the fourth column to the top condenser.

16. The process as claimed in claim 1, wherein at least 40% of the air sent to the column system is expanded in a first turbine to the pressure of the third or a fourth column.

17. The process as claimed in claim 1, wherein at least 50% of the air sent to the column system is expanded in a first turbine to the pressure of the third or a fourth column.

* * * * *